United States Patent [19]

Johnson

[11] 4,301,122

[45] Nov. 17, 1981

[54] RECOVERY OF URANIUM FROM PHOSPHATE ORES

[75] Inventor: George C. Johnson, Princeton, N.J.

[73] Assignee: Mobil Oil Corporation, New York, N.Y.

[21] Appl. No.: 953,060

[22] Filed: Oct. 19, 1978

[51] Int. Cl.[3] ..... C01G 43/00

[52] U.S. Cl. ..... 423/17; 423/15

[58] Field of Search ..... 423/15, 17, 18

[56] References Cited

U.S. PATENT DOCUMENTS

| | | | |
|---|---|---|---|
| T970,007 | 5/1978 | McCullough et al. | 423/18 |
| 2,761,758 | 9/1956 | Long et al. | 423/18 |
| 2,769,686 | 11/1956 | McCullough et al. | 423/10 |
| 2,830,871 | 4/1958 | Kaufman et al. | 423/17 |
| 2,866,680 | 12/1958 | Long | 423/18 |
| 3,174,821 | 3/1965 | Opratko et al. | 423/17 |
| 3,790,658 | 2/1974 | Fox et al. | 423/18 |
| 3,813,233 | 5/1974 | Kendrick | 71/34 |

*Primary Examiner*—Edward A. Miller

*Attorney, Agent, or Firm*—Charles A. Huggett; Michael G. Gilman; Claude E. Setliff

[57] ABSTRACT

Uranium is recovered from phosphate ore in a process comprising making phosphoric acid, partially reacting same with $NH_3$, removing aluminum with dilute sodium carbonate and sodium bicarbonate and extracting the uranium with a concentrated solution of said carbonates.

5 Claims, No Drawings

RECOVERY OF URANIUM FROM PHOSPHATE ORES

BACKGROUND OF THE INVENTION

1. Field of the Invention

The invention relates to the recovery of uranium from phosphate ores. More particularly, it relates to the recovery of uranium from crude phosphoric acid using concentrated solutions of sodium carbonate and sodium bicarbonate.

2. Discussion of the Prior Art

It is well known that Florida phosphate ores contain a minute quantity of uranium. Nonetheless, it is economically feasible to recover the uranium, and this is conventionally done by preparing phosphoric acid and extracting the uranium with solvents such as tributyl phosphate.

Another method for concentrating uranium comprises neutralizing crude phosphoric acid with ammonia. Such "crude phosphoric acid" has been reacted, as a step in its manufacture, with sulfate ion, either from sulfuric acid or from ammonium sulfate, to precipitate most of the calcium as gypsum. Uranium concentrates in the precipitate which forms on ammonia addition. Such ammonia precipitates are formed during the process for making fertilizers. Generally, in the production of fertilizers, the ore is reacted with nitric acid and sulfuric acid and then is ammoniated. A more detailed description of such fertilizer process is taught in U.S. Pat. No. 3,813,233, which, for completeness, is incorporated herein by reference.

SUMMARY OF THE INVENTION

The invention provides a method for recovering uranium from crude phosphoric acid derived from Florida phosphate rock which comprises (1) neutralizing the crude phosphoric acid with ammonia to form a precipitate, (2) treating the precipitate with a dilute solution of sodium carbonate and sodium bicarbonate to dissolve substantially the portion of the precipitate containing ions other than uranium and (3) treating the remaining precipitate from (2) with a concentrated solution of sodium carbonate and sodium bicarbonate to dissolve uranium.

DESCRIPTION OF SPECIFIC EMBODIMENTS

Phosphate ore as mined, without any special preparation, may be used in preparing the crude phosphoric acid. Beneficiated phosphate rock can be used, as well as other by-product streams from the flotation process used in beneficiation. Even phosphate slimes may be used to advantage.

Reaction with $HNO_3$

The main phosphorus mineral in the phosphate ore is fluorapatite, $Ca_{10}(PO_4)_6F_2$, which reacts with nitric acid by the equation:

$$Ca_{10}(PO_4)_6F_2 + 20\ HNO_3 \rightarrow 10\ Ca(NO_3)_2 + 6\ H_3PO_4 + 2\ HF$$

The ore also contains carbonate, in the form of the incompletely defined carbonate apatite, and may be represented by the carbonate ion:

$$CO_3^{--} + 2\ HNO_3 \rightarrow 2\ NO_3^- + CO_2\uparrow + H_2O$$

The carbon dioxide is given off as a gas during the reaction and has served as an indicator of the completion of the reaction. The carbonate is an integral part of the mineral, for example, as $Ca_{10}(PO_4)_5CO_3OH\ F_2$, and $CO_2$ evolution ceases when the ore is completely dissolved. The hydrogen fluoride shown in the reactions above probably reacts further with aluminum ion to form other ions such as $AlF_6^{---}$ or $AlF_2^+$. Wavellite in the ore would also dissolve:

$$Al_3(OH)_3(PO_4)_2 \cdot 5\ H_2O + 9\ HNO_3 \rightarrow 3\ Al(NO_3)_3 + 2\ H_3PO_4 + 2\ H_2O$$

The nitric acid concentration may range, practicably, from about 10% to about 70%. For example, the acid might be the 61% to 65% $HNO_3$ produced on site. There should be at least enough $HNO_3$ present to satisfy the material balance in the above formula. Desirably, an excess, e.g. about 20% over the theoretical amount required for complete reaction, may be used.

The temperature is not critcal, except that it should, for the purpose of the present invention, be kept low enough to prevent the loss of fluorine as volatile HF or $SiF_4$. Thus the temperature of reaction of the ore with $HNO_3$ will be within the range of from ambient to 60° C., preferably from about 35°-45° C.

The ratio of water to ore used in the reactor is a compromise between two factors:

(1) Higher water/ore ratios facilitate the liquid/solid separation after the reactor. At low water/dry ore ratios (.64 g/g.) a foamy, gelatinous reactor product is formed that can barely be poured through a 24/40 standard taper joint and looks like a tan meringue.

(2) Higher water/ore ratios add to the heat load of the evaporator and also make it more difficult to precipitate all of the gypsum. The optimum value for the water/dry ore ratio was found to be from about 1.2 to about 1.8 g/g.

At the conclusion of the reaction period, which should range for from about 10 to about 30 minutes, the reactor will contain sand, clay and some other solids plus a solution containing ions of calcium, aluminum, iron, magnesium, phosphorus, fluorine, silicon, nitrogen, uranium, or mixtures thereof.

The reactor effluent may be separated into solid and liquid by one of several methods, including centrifuging, filtering and settling. Of the three, centrifuging is preferably on a commercial scale. The effluent is generally clear and yellow, with only traces of scum and low density particles. The reactor product is generally quite acid (pH below 2) and will contain significant amounts of multivalent ions in solution.

The filtrate may be reacted with sulfate ion (from sulfuric acid or ammonium sulfate, for example) to remove calcium as the sulfate (gypsum). The temperature of this reaction should be from ambient to about 80° C. Contact times of as little as about 15 minutes are sufficient to precipitate about 98% of the calcium. However, longer periods, e.g. from about 12 to about 16 hours, are preferred to ensure maximum precipitation.

The filtrate from the gypsum precipitate is neutralized with ammonia or ammonia water to a pH of up to 7.0 to 7.5 or 8.0; preferably 7.0 or higher. Uranium concentrates in the precipitate at pH 4.0 but more uranium precipitates if the pH is 7.0 to 8.0. Iron, aluminum and fluorine also concentrate in this precipitate. Part of the ammonia and phosphate are included in the ammonia precipitate as $AlNH_4HPO_4F_2$ or related materials.

The reaction with ammonia is maintained at a temperature of from 50° C. to about 80° C., preferably from about 50° C. to about 60 ° C.

The precipitate is removed from the liquid and is dispersed in a dilute aqueous solution of sodium carbonate and sodium bicarbonate. For this phase of the method, and when using one liter of solution for each 10 grams of precipitate, the solution should contain from about 0.05 to about 10 grams of total carbonate (i.e., sodium carbonate plus sodium carbonate). Preferably the solution should contain about 10 grams of total carbonate for each 10 grams of precipitate. The temperature in this first stage can range from ambient to about 100° C. at atmospheric pressure. In closed vessels, temperatures up to at least 150° C. can be used at autogeneous pressure.

After the remaining solid precipitate is filtered off it is added to a solution containing, for example, from about 40 grams to about 100 grams of total carbonate per liter. Thus, the amount of total carbonate should be about 40 to about 100 parts per 10 parts of original precipitate.

The carbonate solution can be made from about 0.2 formula weight to about 1 formula weight of sodium bicarbonate per formula weight of sodium carbonate, preferably about 1.0 formula weight of bicarbonate per formula weight of carbonate.

The temperature for this step is the same as the above comparable step. An oxidizing atmosphere, to keep the uranium in the six-valent state, is desirable and an atmosphere of oxygen gas or air is suitable.

The amount of solution can be varied somewhat from the ratio of one liter of solution for each 10 grams of precipitate. Enough solution should be used to provide dispersion of the precipitate and to provide enough carbonate for the reaction. The ratio of total carbonates to precipitate shoud be 0.05 to 1 for the first step and 4 to 10 for the second step.

The optimum amounts of the reagents will depend on the concentrations of the various elements in the precipitate and these depend, in turn, on the composition of the phosphate ore and the conditions used when dissolving the phosphate feed. For example, if the ore is low in aluminum, and a minimum amount of acid is used to dissolve the ore, the precipitate will have a lower aluminum/uranium ratio than shown in Table 3 and less total carbonate can be used in the first step—in the direction of less than 10 grams of total carbonate for each 10 grams of precipitate.

The solution used in step two can be recycled to build up uranium content.

The following example illustrates the invention.

Examples

The precipitates worked on were made in general accordance with the following method.

The phosphate feed used was a raw phosphate ore and had the following analysis:

TABLE 1

| Composition of Dry Matrix | |
|---|---|
| P, wt. % | 3.91 |
| Ca | 13.5 |
| Mg | .2 |
| F | 1.85 |
| Fe | .60 |
| Na | .23 |
| $SiO_2$ | 50.6 |
| $Al_2O_3$ | 4.73 |
| Organic C | .55 |

TABLE 1-continued

| Composition of Dry Matrix | |
|---|---|
| Ash, 1000° C. | 96.4 |
| $U_3O_8$ | .004 |
| Ra[a] | $1 \times 10^{-9}$ |
| $P_2O_5$ | 9.0 |
| BPL[$Ca_3(PO_4)_2$] | 19.6 |
| P/Ca atom ratio | .38 |
| F/Ca atom ratio | .29 |

[a]On basis of U/Ra ratio averages of $2.94 \times 10^6$ in phosphate rocks.

170 g. of this ore was placed in a reactor and reacted with 150 cc. of 40% nitric acid over a period of 1½ minutes and was then stirred for an additional 13½ minutes. During this time, the temperature reached a maximum of 41° C., and 670 cc. of carbon dioxide was evolved.

900 cc. of water was added, the mixture was allowed to settle and the clear layer was drawn off. The solid collected was extracted with water, the extract being combined with the said clear layer. The solid was dried to produce 83.41 g. of unreacted materials (sand, clay and the like). Then 35 cc. of 66% sulfuric acid was added to the combined clear layer and the extract and the whole was evaporated to 580 cc., whereupon a precipitate of gypsum appeared. The solid/liquid mixture was vacuum filtered and then the solid was water-washed. The washed gypsum was dried over a steam bath to a constant weight of 51.91 g.

The filtrate was neutralized with ammonia water below room temperature. An ice bath was used to keep the mixture cold. The precipitate was filtered and treated, under varying conditions, including varying total amounts or carbonates as shown in Examples 1–6.

Example 5 serves as an illustrative run. 10.0 g. of a precipitate obtained as described herein above was placed in a 2-liter, 4 neck flask and covered with one liter of water containing 26.5 g. of sodium carbonate and 21.0 g. of sodium bicarbonate (0.25 formula weight of each reagent). The flask was flushed with oxygen and an oxygen atmosphere was maintained throughout the run. The mixture was stirred vigorously and heated at reflux, about 100° C., for 22 hours, cooled, and vacuum filtered. A small precipitate of ammonium carbonate appeared during the run near the top of the water condenser. The undissolved solid on the filter was washed twice with water in plug flow and dried in a vacuum oven at 100° C. and 250 mm Hg. absolute pressure. The dried solid ("residue" in Table 2) was weighed, dissolved in nitric acid, and made up to 115.00 g. with water to provide a sample for uranium analysis. A small amount of the solid, 0.22 g. did not dissolve.

The filtrate was acidified with nitric acid, boiled down to about 150 cc. and made up with water to 200.00 g. for the uranium analysis. The uranium analyses was made by the spectrophotometric method of Francois, Anal. Chem. 30, 50 (1958). Details of the experiments are collected in Table 2. In each of the examples from 2 through 6 equimolecular amounts of sodium carbonate and sodium bicarbonate were used. This corresponds to the quantities of the two materials in sodium sesquicarbonate, the main component of the ore trona. Uranium was found to be absent from the nitric acid, sodium carbonate and sodium bicarbonate used as reagents.

The results of all the tests using carbonates are summarized in Table 2.

TABLE 2

REMOVAL OF URANIUM FROM AMMONIA PRECIPITATES BY CARBONATE EXTRACTION

| Example | 1 | 2 | 3 | 4 | 5 | 6 |
|---|---|---|---|---|---|---|
| Wt. of Precipitate, g. | 5.00 | 10.00 | 10.00 | 10.00 | 10.00 | 10.00 |
| Wt. of $Na_2CO_3$, g. | 0 | .53 | 5.30 | 5.30 | 26.50 | 53.00 |
| Wt. of $NaHCO_3$, g. | .0529 | .42 | 4.20 | 4.20 | 21.00 | 42.00 |
| Wt. of Water, g. | 42.86 | — | — | — | — | — |
| Vol. of Soln. cc. | — | 1000 | 1000 | 1000 | 1000 | 1000 |
| Gas Used | Air | $O_2$ | $O_2$ | $O_2$ | $O_2$ | $O_2$ |
| Temperature, C. | 25 | 101 | 101 | 101 | 102 | 102 |
| Time, hr. | 22 | 22 | 20 | 23 | 22 | 20 |
| Residue, g. | 4.24 | 7.38 | 5.46 | 6.28 | 5.23 | 5.35 |
| Precipitate Dissolved Wt. % | 15.2 | 26.2 | 45.4 | 37.2 | 47.7 | 46.5 |
| Uranium in Precipitate, g. | .00070 | .0019 | .0019 | .0019 | .0019 | .0019 |
| Uranium in Solution, g. | .0000 | .0000 | .0001 | .0002 | .0018 | .0027 |
| Uranium in Residue, g. | .00076 | .0019 | .0022 | .0023 | .0008 | .0001 |
| Uranium Recovery, Wt. % | 108 | 100 | 121 | 132 | 137 | 146 |
| Uranium Dissolved, Wt. % | 0 | 0 | 5 | 9 | 69 | 95 |
| Uranium Content, ppm of Precipitate | 141 | 190 | 190 | 190 | 190 | 190 |
| Residue, ppm | 178 | 257 | 403 | 366 | 154 | 19 |

Table 3 sets forth analyses of the precipitates used in Examples 1–6.

TABLE 3

ANALYSES OF PRECIPITATES

| Component | Precipitate used in Example 1 wt. % | Precipitate used in Examples 2–6 wt. % |
|---|---|---|
| Phosphorus | 15.1 | 15.5 |
| Calcium | 17.8 | 15.0 |
| Magnesium | .80 | .52 |
| Fluorine | 4.52 | 5.30 |
| Silica | 2.03 | 1.88 |
| Alumina | 5.28 | 10.30 |
| Sulfate | .50 | 2.06 |
| Iron | .68 | 1.1 |
| Ammonia | 2.32 | 3.49 |
| Uranium | .0141 | .0190 |
| Ash, 750° C. | 71.9 | 70.90 |

It is clear from Table 2 that uranium extraction was extremely low or did not occur at all at low carbonate concentrations (Examples 1–4), but with high concentrations of such ions the metal was extracted to the extent of about 70% or more (Examples 5 and 6). Other materials, such as aluminum, were dissolved from the precipitate before appreciable uranium was dissolved. For instance, in Example, 3 45% of the precipitate was dissolved while no more than 5% of uranium was taken up into solution.

Since it has been shown that low concentrations of carbonates (relative to the weight of carbonates per weight precipitate and the volume of water) remove portions of the precipitate not containing uranium, this suggests a method employing at least one extraction with a dilute solution of carbonates and at least one with a concentrated solution thereof.

I claim:

1. A method for recovering uranium from ammonium precipitate containing same which comprises (1) treating, at from ambient temperatures to about 150° C., the ammonium precipitate with a dilute solution of sodium carbonate and sodium bicarbonate to remove substantially the portion of the said precipitate containing ions other than uranium, the total carbonate content of said solution being from about 0.05 to about 10 parts per 10 parts of said precipitate, and (2) treating, at from ambient temperatures to about 150° C., the remaining precipitate with a concentrated solution of sodium carbonate and sodium bicarbonate to remove uranium, the total carbonate content in said solution being from about 40 to about 100 parts per 10 parts of the original precipitate.

2. The method of claim 1 wherein in both steps the solution contains from 0.2 to about 1.0 formula weight of bicarbonate per formula weight of carbonate.

3. The method of claim 1 wherein the temperature in both steps is from ambient to about 100° C. in open vessels.

4. The method of claim 1 wherein in step 2, 9.5 parts of total carbonate per part of precipitate is employed.

5. The method of claim 1 wherein in step 2 the solution comprises 9.5 parts of total carbonate per 100 parts of water.

* * * * *

UNITED STATES PATENT AND TRADEMARK OFFICE

CERTIFICATE OF CORRECTION

PATENT NO. : 4,301,122

DATED : November 17, 1981

INVENTOR(S) : George C. Johnson

It is certified that error appears in the above-identified patent and that said Letters Patent are hereby corrected as shown below:

Column 4, line 29, "51.91" should be --51.92--.

Signed and Sealed this

*Twenty-third* Day of *February 1982*

[SEAL]

*Attest:*

GERALD J. MOSSINGHOFF

*Attesting Officer*

*Commissioner of Patents and Trademarks*